US006031919A

United States Patent [19]

Funahashi et al.

[11] Patent Number: 6,031,919

[45] Date of Patent: Feb. 29, 2000

[54] LOUDSPEAKER SYSTEM AND SOUND REPRODUCING APPARATUS

[75] Inventors: Osamu Funahashi, Takatsuki; Norimitsu Kurihara, Wako, both of Japan

[73] Assignee: Matsushita Electric Industrial Co., Ltd., Osaka, Japan

[21] Appl. No.: 08/832,467

[22] Filed: Apr. 2, 1997

[30] Foreign Application Priority Data

Apr. 3, 1996 [JP] Japan ..... 8-081260

[51] Int. Cl.[7] ..... H04R 25/00

[52] U.S. Cl. ..... 381/150; 381/351; 381/337; 381/86; 381/93; 181/145; 181/199; 181/160

[58] Field of Search ..... 381/87, 86, 89, 381/332, 335, 345, 349, FOR 145–146, FOR 182, FOR 186, 337–338, 351, 150, 386, 93; 181/144, 145, 147, 155, 156, 160, 171, 182, 196, 198, 199

[56] References Cited

U.S. PATENT DOCUMENTS 4,074,070 2/1978 Gaus ..... 381/86
4,165,445 8/1979 Brosow ..... 381/86
4,924,963 5/1990 Polk ..... 181/144
4,944,018 7/1990 Bose et al. ..... 381/86
5,092,424 3/1992 Schreiber et al. ..... 181/145
5,825,901 10/1998 Hisey ..... 381/86

*Primary Examiner*—Curtis A. Kuntz
*Assistant Examiner*—Rexford N. Barnie
*Attorney, Agent, or Firm*—McDermott, Will & Emery

[57] ABSTRACT

In the invented speaker system, a passive radiator 401 is mounted on a top board 403*a* of baffle 403 in a direction opposite to a speaker unit 402. The speaker unit 402 is mounted on the opening of a cylinder 403*b* protruding from top board 403*a* at a place inner from the end. The remaining part of the opening is closed with a sub-baffle 406, to form a front closed cavity 404 and a back closed cavity 405. In this way, both the passive radiator 401 and the speaker unit 402 are fixed to the top board 403*a* whose rigidity being the highest; which reduces the unwanted vibration.

23 Claims, 14 Drawing Sheets

LOUDSPEAKER SYSTEM AND SOUND REPRODUCING APPARATUS

BACKGROUND OF THE INVENTION

The present invention is related to a loudspeaker system and a sound producing apparatus, specifically to a loudspeaker system and a sound producing apparatus advantageous for use in a car.

In the era of popular use of Compact Disk(CD), Mini Disk(MD), Digital Audio Tape(DAT) and other digital sound sources, loudspeaker systems are requested to be able to reproduce the recorded sound for a wide range. In order to improve the low range sound reproduction, Kelton type speakers have been known, in which a speaker unit and a passive radiator are combined.

In the following, a conventional Kelton type speaker system having passive radiator is described referring to Fig.14. The conventional speaker system comprises a passive radiator 101 which actually produces a sound, a speaker unit 102 for driving the passive radiator 101, a baffle 103, being a constituent of speaker box, for mounting the passive radiator 101 on, a front closed cavity 104 for coupling the sound output of speaker unit 102 with the passive radiator 101, a back closed cavity 105 for sealing the backward sound output of speaker unit 102 in, a sub-baffle 106, which splits a space into the front closed cavity 104 and the back closed cavity 105, for mounting the speaker unit 102 on, and a cabinet 107 which constitutes a speaker box in combination with the baffle 103. The sub-buffle 106 is fixed to the side wall of speaker box.

FIG. 15 is an equivalent circuit diagram of a conventional Kelton type speaker system having passive radiator. Represented in FIG. 15 are: an electromagnetic resistance 201 due to reverse electromotive force of speaker unit etc., a mechanical resistance 202 of speaker unit, an equivalent mass 203 due to the mass of speaker diaphragm etc., a compliance 204 due to damper and edge etc. of speaker unit, a transformer 205 conducting the sound output of speaker unit to a passive radiator in proportion to the area ratio, a mechanical resistance 206 of passive radiator, a compliance 207 due to damper and edge etc. of passive radiator, an equivalent mass 208 due to the mass of passive radiator diaphragm etc., a compliance 209 due to front closed cavity, and a compliance 210 due to back closed cavity.

Now in the following, description is made on the operation of a conventional speaker system having the above described constitution. A sound is produced, as illustrated in FIG. 14, by a sound producing output discharged from the front of speaker unit 102, which drives the passive radiator 101 mounted on baffle 103 by means of the air existing within front closed cavity 104 formed by baffle 103 and sub-baffle 106; the passive radiator 101 actually produces a sound. A sound producing output discharged from the back of speaker unit 102 is sealed within the back closed cavity 105 formed by sub-baffle 106 and cabinet 107 so as it does not interfere with the sound producing output of passive radiator 101.

FIG. 16 is a comparison of low range sound producing characteristics, showing the advantages of a conventional Kelton system having passive radiator. In FIG. 16, a line 301 represents the frequency characteristics of output sound pressure level in a sealed cabinet system. In the sealed cabinet system, sound producing output generated from the back of a speaker unit is sealed within a speaker box in order to avoid the interference with the sound producing output from the front of speaker unit. If a speaker box is not sufficiently large, the compliance with respect to the speaker unit deteriorates, and the low range producing capability is limited, as indicated by the shape of line 301.

A line 302 represents the frequency characteristics of output sound pressure in a reversed phase system using a same type speaker unit and speaker box. In the reversed phase system, a sound producing output generated from the back of a speaker unit is made to resonate through a duct of the speaker box at a certain frequency(hereinafter referred to as anti-resonance frequency), which is mixed with a sound producing output from the front of speaker unit. The sound producing output through the duct has a same phase as that from the front of speaker unit at the vicinity of the anti-resonance frequency, which improves the radiation efficiency by mutual effects and the limit of low range sound is extended as compared with the sealed cabinet system. In a very low frequency range, however, the phase of sound producing output through the duct is reversed against the sound producing output from the front of speaker unit, which invites the mutual offsetting. As a result, the characteristics curve shows a steep decrement of approximately −20 dB/oct. in the very low frequency range. Therefore, heavy bass production remains unsatisfactory.

A line 303 represents the frequency characteristics of output sound pressure in a conventional Kelton system having passive radiator using a same type speaker unit and speaker box. In the same manner as in the reversed phase system, the Kelton system makes passive radiator, speaker unit and speaker box resonate at a certain frequency (hereinafter referred to as lowest resonance frequency), extending the limit of low range sound production. As the passive radiator and the speaker unit resonate in a same phase, the decrement at very low frequency range follows a same moderate curve approximately −12 dB/oct. as that of the sealed cabinet system, producing a sufficient heavy bass. Furthermore, the passive radiator does not vibrate in a frequency range higher than a certain frequency despite a vibrating speaker unit, which means that the system is provided also with an excellent band pass characteristic as a low range speaker.

As described above, a conventional Kelton system having passive radiator improves the low range sound production providing the advantages of both the sealed cabinet system, good production of heavy bass which is due to moderate decrement characteristic in very low frequency range, and the reversed phase system, an extended limit of low range production.

The conventional Kelton system having passive radiator is a speaker system quite effective in improving the low range production, as described above. In the system, however, the sub-baffle for splitting a space inside the speaker box into a front closed cavity and a back closed cavity is mounted on it with a speaker unit, being a vibration source, and is fixed to the side wall of speaker box, which makes the sub-baffle itself a source of unwanted vibration due to the counteraction of speaker unit. This accompanies a problem, that is a larger unwanted vibration of a speaker system itself.

Another problem with the system is that in a compact or flat configuration it is difficult to obtain an ideal sound characteristic because of the structural limitation in reducing the volume of front closed cavity; the reason is, one of the parameters which give a substantial influence on the sound characteristics of this type of speaker system is the ratio in volume between front closed cavity and back closed cavity, and there is a limitation in making the volume of front closed cavity small in a structure where a space is splitted into front closed cavity and back closed cavity by a sub-baffle.

SUMMARY OF THE INVENTION

The present invention is aimed to present a speaker system having a reduced unwanted vibration. It is also aimed to present a compact speaker system having an improved sound characteristic.

For implementing the objectives, a speaker system according to the present invention comprises a speaker unit connected with sound input signal terminals, a passive radiator driven by a sound output from the speaker unit, a front closed cavity having the passive radiator for coupling the sound output of speaker unit with said passive radiator, a back closed cavity for sealing the sound output of speaker unit in, a baffle having a top board for installation of the passive radiator and constituting a part of speaker box, and a cabinet which constitutes a speaker box in combination with the baffle, wherein the speaker unit is mounted on a mounting member fixed to the top board at a place other than the end.

A sound producing apparatus according to the present invention comprises said speaker system, a power amplifier for supplying sound production signal to the speaker system, a microphone for detecting sound output signal radiated from either the speaker unit or the passive radiator, and a sound feedback circuit for feeding the sound signal from microphone to the power amplifier.

According to the above described structure where both the speaker unit, being a vibration source, and the passive radiator are fixed direct to the top board of baffle, whose rigidity being the highest, the unwanted vibration of sub-baffle caused by the counteraction of speaker unit is significantly reduced, and the unwanted vibration of a speaker system itself is lowered. Furthermore, by mounting a speaker unit direct on the top board of baffle the volume ratio of the front closed cavity can be minimized even in a compact or flat configuration; which helps improve the sound characteristics of a speaker system, as well as a sound production apparatus.

PREFERRED EMBODIMENTS OF THE INVENTION

Figure 1:
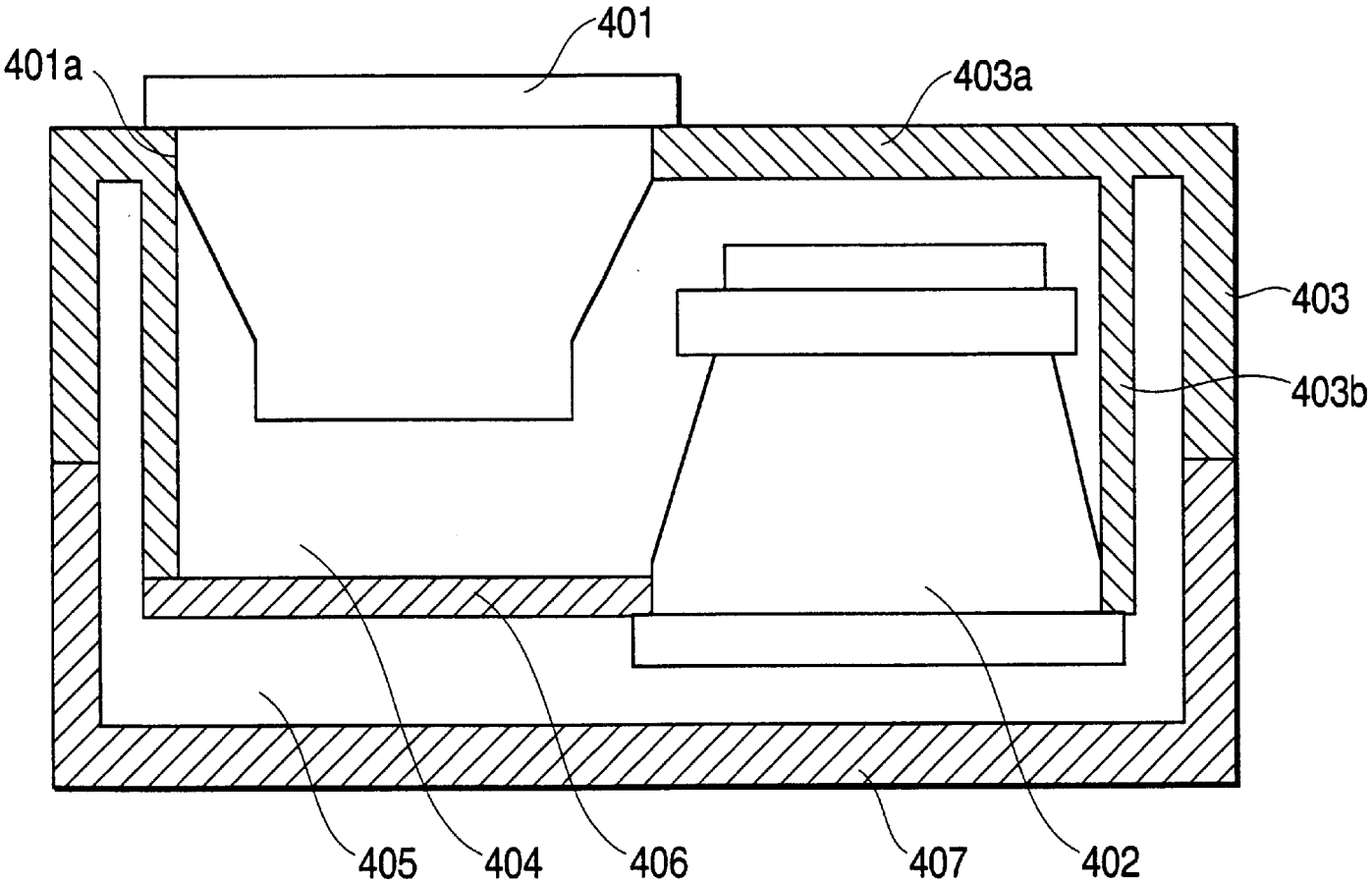
FIG. 1 is a cross sectional view showing a Kelton type speaker system having passive radiator, according to a first embodiment of the present invention.
Figure 2:
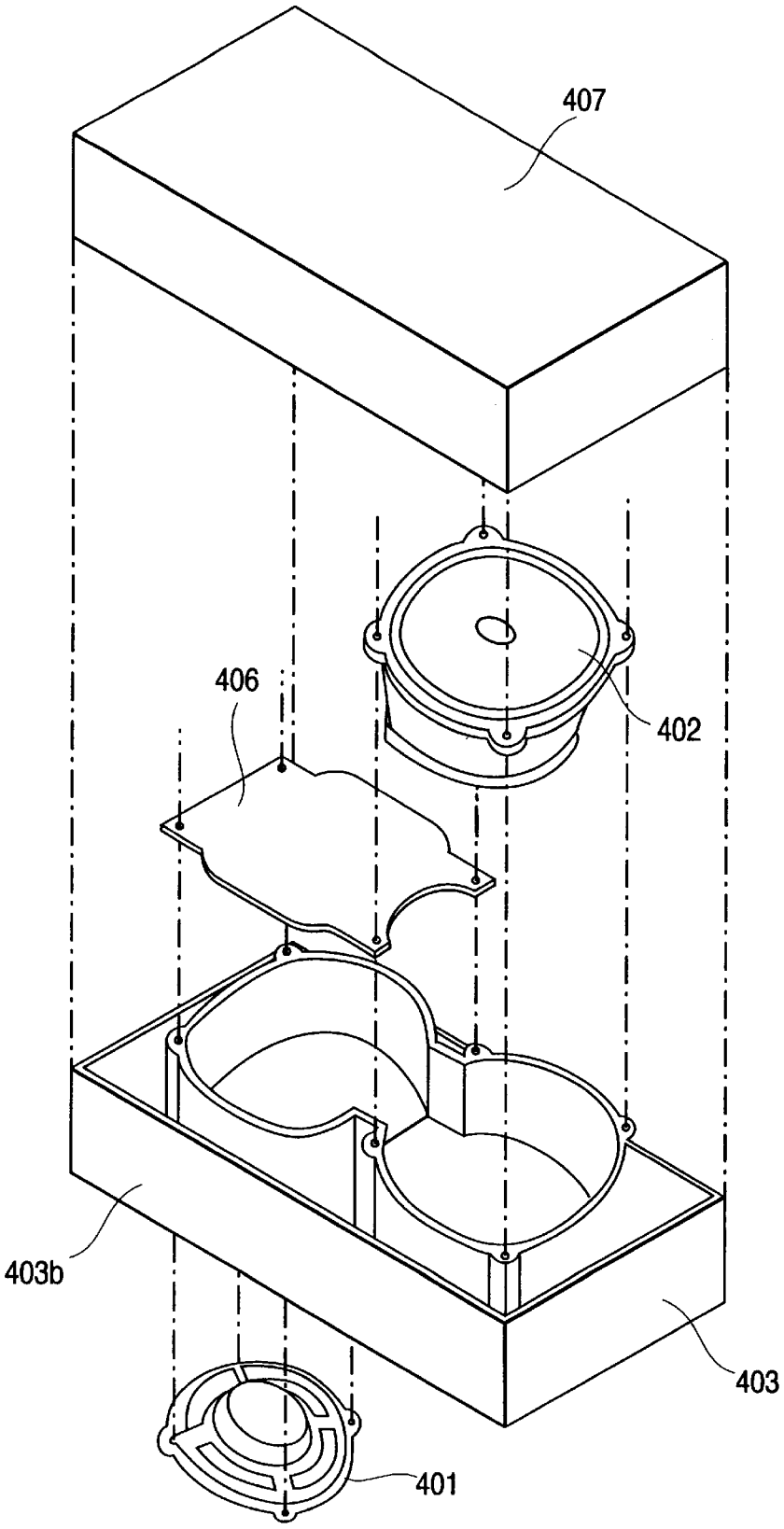
FIG. 2 is an exploded perspective view of the speaker system of FIG. 1.

A speaker system according to a first embodiment of the present invention as shown in FIG. 1 and FIG. 2 comprises a passive radiator 401 which actually produces a sound, a speaker unit 402 for driving the passive radiator 401 by a sound output from the back, a baffle 403 being a constituent of speaker box for mounting the passive radiator 401 and the speaker unit 402 altogether on, a front closed cavity 404 for coupling a sound output from the back of speaker unit 402 with the passive radiator 401, a back closed cavity 405 for sealing a sound output from the front of speaker unit 402 in, a sub-baffle 406 splitting a space into the front closed cavity 404 and the back closed cavity 405, and a cabinet 407.

Speaker unit 402 is mounted on an opening of a cylinder 403*b* protruding from a top board 403*a* of baffle 403 at a place inner from the end. The remaining portion of opening of cylinder 403*b* is closed with a sub-baffle 406; the front closed cavity 404 is formed with top board 403*a*, cylinder 403*b* and sub-baffle 406. The baffle 403 is comprised of a high rigidity material, the top board 403*a* is made to have the highest rigidity.

The manufacturing process may be simplified by gluing or welding a diaphragm 401*a* of passive radiator 401 direct to the top board 403*a*.

Figure 3:
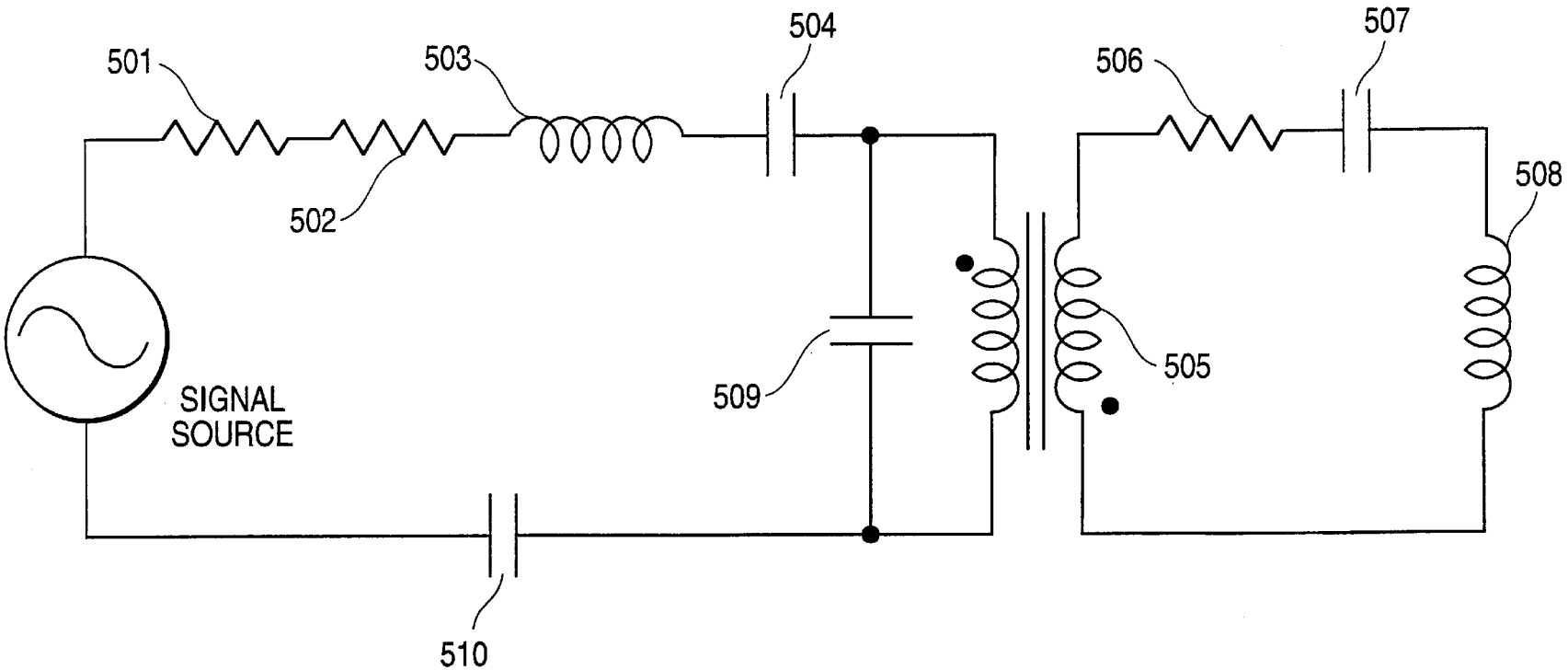
FIG. 3 is an equivalent circuit diagram of the speaker system of FIG. 1.

FIG. 3 shows an equivalent circuit diagram of the speaker system of FIG. 1. The equivalent circuit comprises an electromagnetic resistance 501 due to counter electromotive force of speaker unit etc., a mechanical resistance 502 of speaker unit, an equivalent mass 503 due to the mass of speaker diaphragm etc., a compliance 504 due to damper and edge etc. of speaker unit, a transformer 505 conducting a sound output of speaker unit to a passive radiator in a reverse phase in proportion to the ratio of areas, a mechanical resistance 506 of passive radiator, a compliance 507 due to damper and edge etc. of passive radiator, an equivalent mass 508 due to the mass of passive radiator diaphragm etc., a compliance 509 due to front closed cavity, and a compliance 510 due to back closed cavity.

Figure 7A:
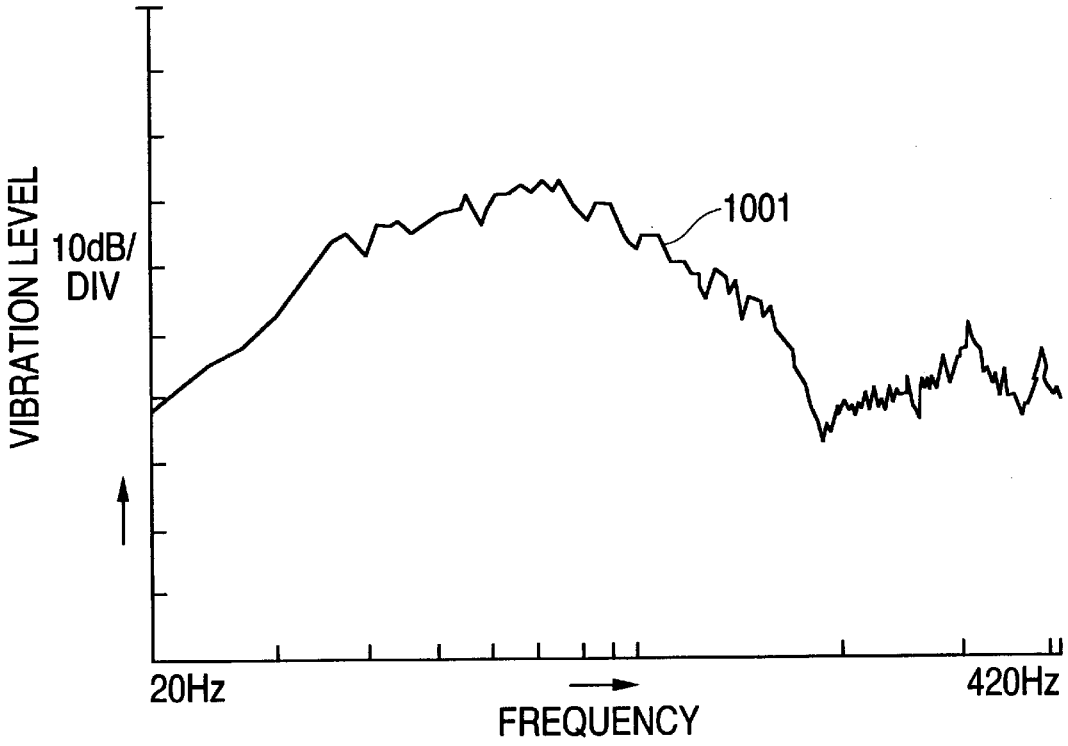
FIG. 7 illustrates vibration level; that of a conventional speaker box in (a), that of the speaker box of FIG. 1 in (b).
Figure 7B:
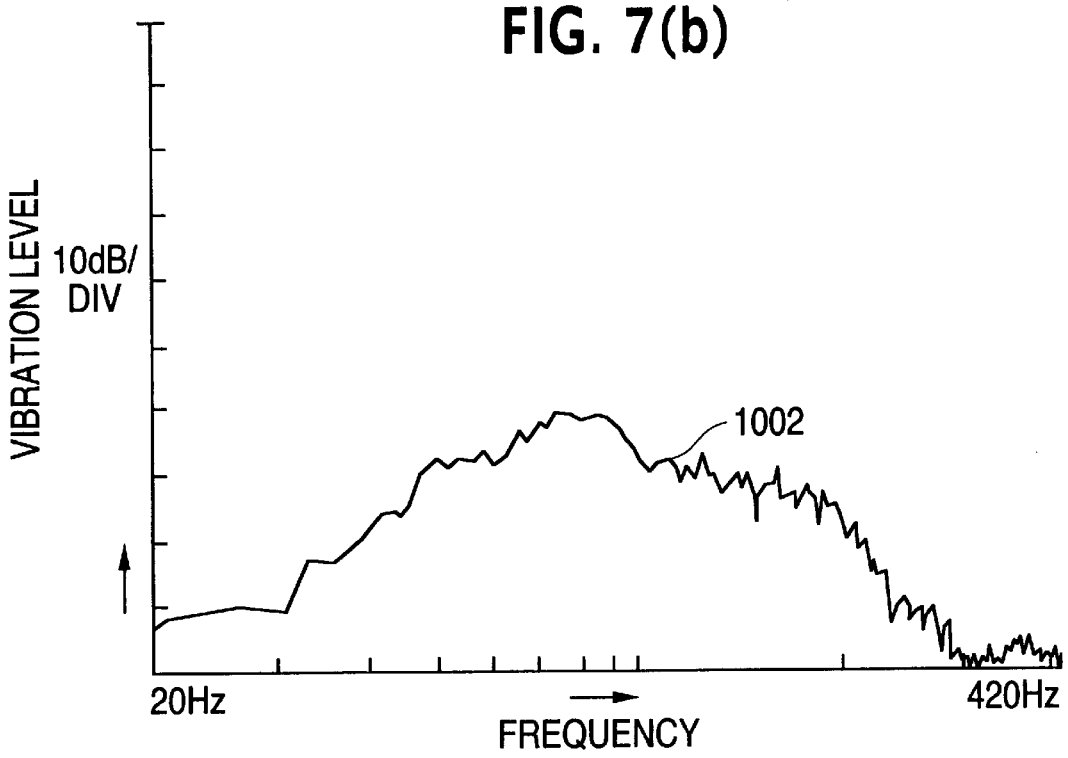

FIG. 7(*a*), FIG. 7(*b*) compare the vibration level of Kelton type speaker box having passive radiator; characteristics curve 1001 represents the vibration level of a conventional speaker box, 1002 represents the vibration level of a speaker box according to the present embodiment; measured in both cases at the surface of baffle.

Figure 8A:
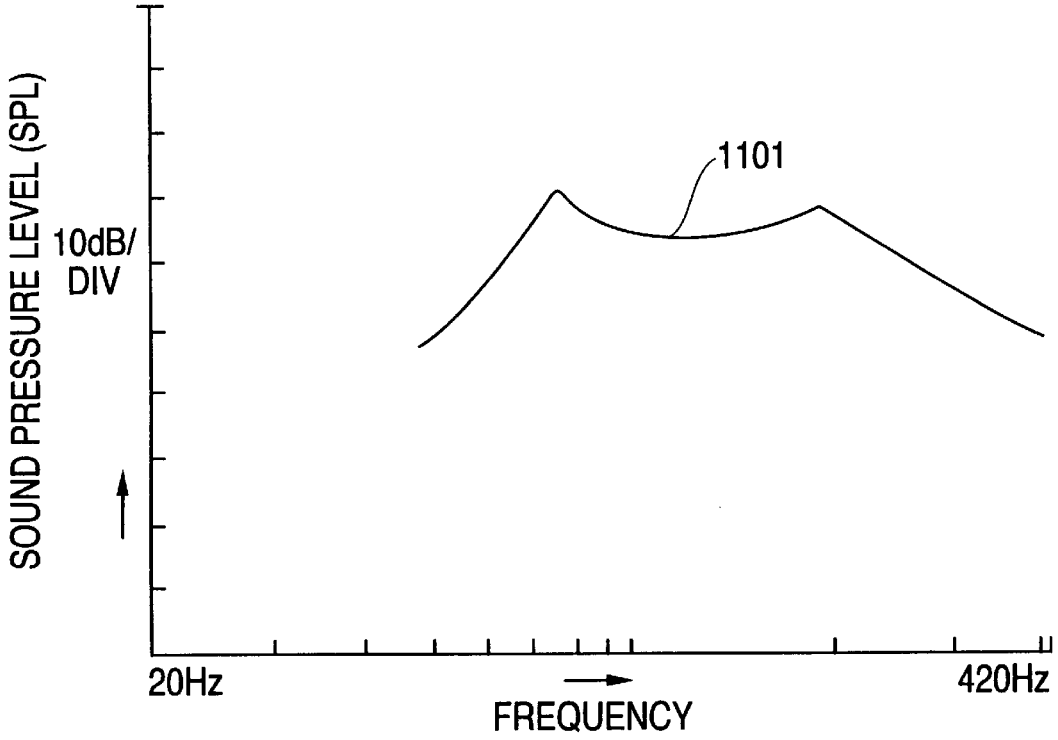
FIG. 8 shows frequency characteristics of a sound produced by a conventional speaker system in (a), those by the speaker system of FIG. 1 in (b).
Figure 8B:
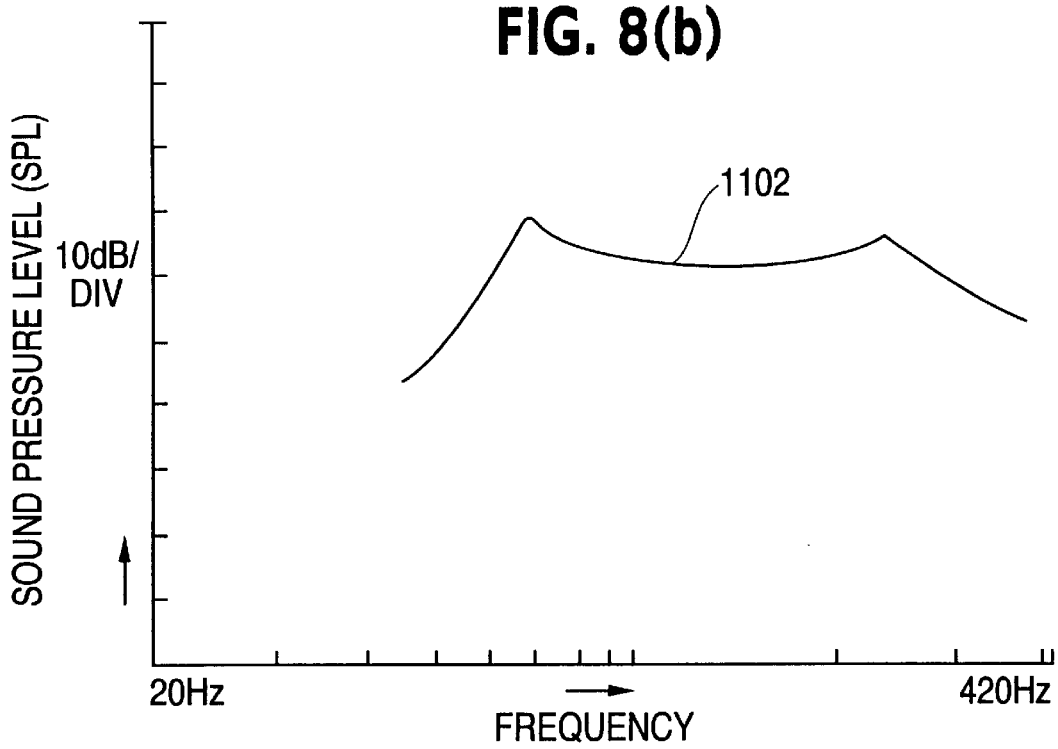

FIG. 8(*a*), FIG. 8(*b*) compare the frequency characteristics of Kelton type speaker box having passive radiator; curve 1101 represents the sound frequency characteristics of a conventional speaker box, curve 1102 represents the sound frequency characteristics of a speaker box according to the present embodiment.

In a Kelton type speaker system having passive radiator according to the present embodiment, speaker unit 402 is mounted in a reverse orientation relative to passive radiator 401, and a sound output from the back of speaker unit 402 is conducted via the air of front closed cavity 404 to passive radiator 401 to produce a sound therefrom. The function of sub-baffle 406 is simply to split a space into front closed cavity 404 and back closed cavity 405. The source of vibration, namely speaker unit 402 and passive radiator 401 are mounted direct onto the baffle 403, the rigidity of which being the highest; therefore, the unwanted vibration of sub-baffle 406 due to counteraction of speaker unit 402 is significantly reduced, and the unwanted vibration of speaker system itself is reduced. From the comparison of the conventional vibration level 1001 and that of the present embodiment 1002, it is understood that the vibration of speaker box is substantially reduced in the present embodiment.

In a compact or flat configuration, the direct mounting of speaker unit 402 onto baffle 403 helps keep the volume ratio of the front closed cavity reduced. This brings about an improved limit of low range production in the present embodiment, as represented by the sound frequency characteristics 1102 versus conventional 1101; thus the sound characteristics of a speaker system is improved.

The back closed cavity 405 is to seal the front sound output of speaker unit 402 in, so as the front sound output from speaker unit does not interfere with the sound output from passive radiator.

In a speaker system according to the present embodiment, a sound output from the back of speaker unit 402 is conducted via the air of front closed cavity 404 to passive radiator 401 to obtain a sound output from the passive radiator 401, therefore the speaker unit 402 and the passive radiator 401 are reverse-phased. Transformer 505 represents the above described situation. For a case of joint use with other speaker system, the sound signal input terminal of a speaker system according to the present embodiment is coupled with speaker unit 402 in the reverse phase.

Figure 4:
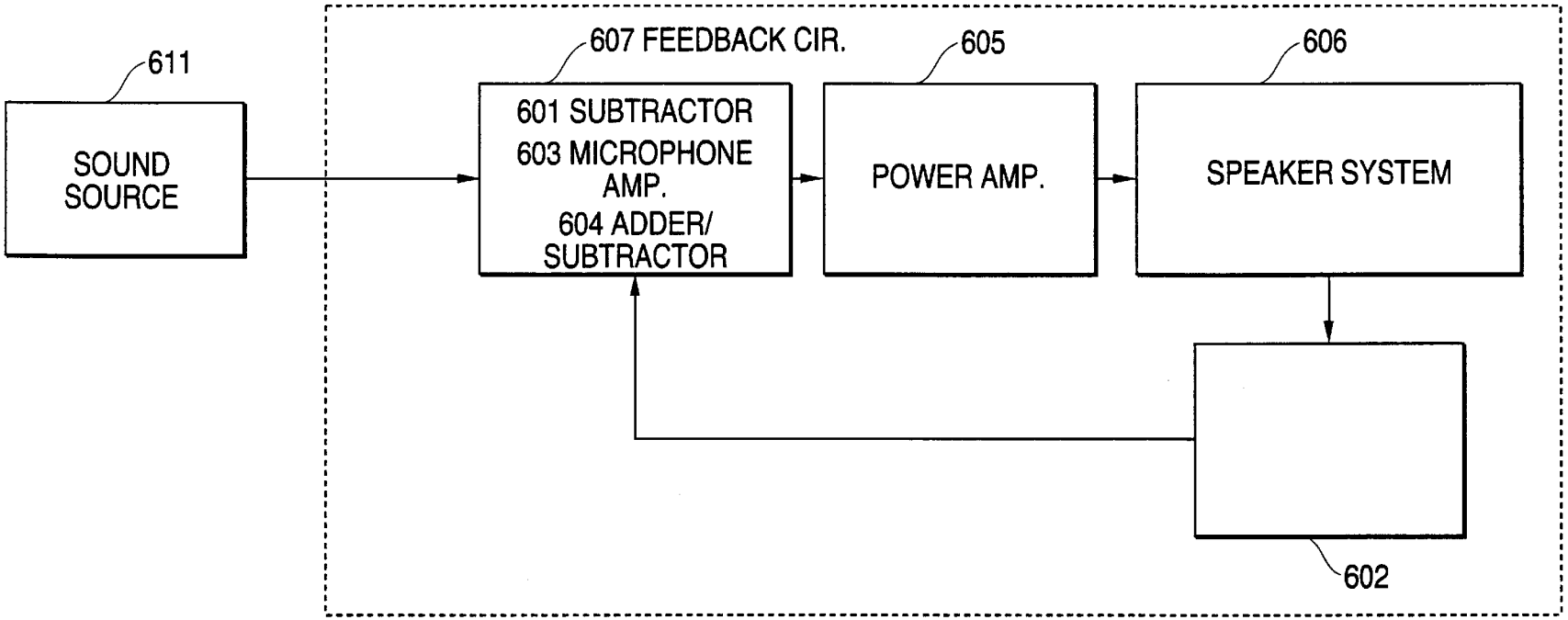
FIG. 4 is a block diagram of a sound producing apparatus comprising the speaker system of FIG. 1 with a built-in power amplifier to be used as subwoofer.

FIG. 4 is a block diagram showing an application of the present embodiment, a sound producing apparatus in which the speaker system of FIG. 1 with built-in power amplifier is used as subwoofer. The sound producing apparatus comprises a pulse width modulating type power amplifier 605 which amplifies only the low range signal of sound input signal, a speaker system of FIG. 1 606 which reproduces sound output signal from power amplifier 605, and a sound feedback circuit 607 which detects with a microphone 602 a sound signal radiated from speaker system 606 for controlling the sound signal based on output signal from the microphone 602. The feedback circuit 607 is formed in a stage before the power amplifier 605. Here, the sound feedback circuit 607 and power amplifier 605 constitute a power amplifying means for amplifying only the low range signal of sound output signal from a sound source 611, and delivers the amplified to the speaker system 606.

Figure 5:
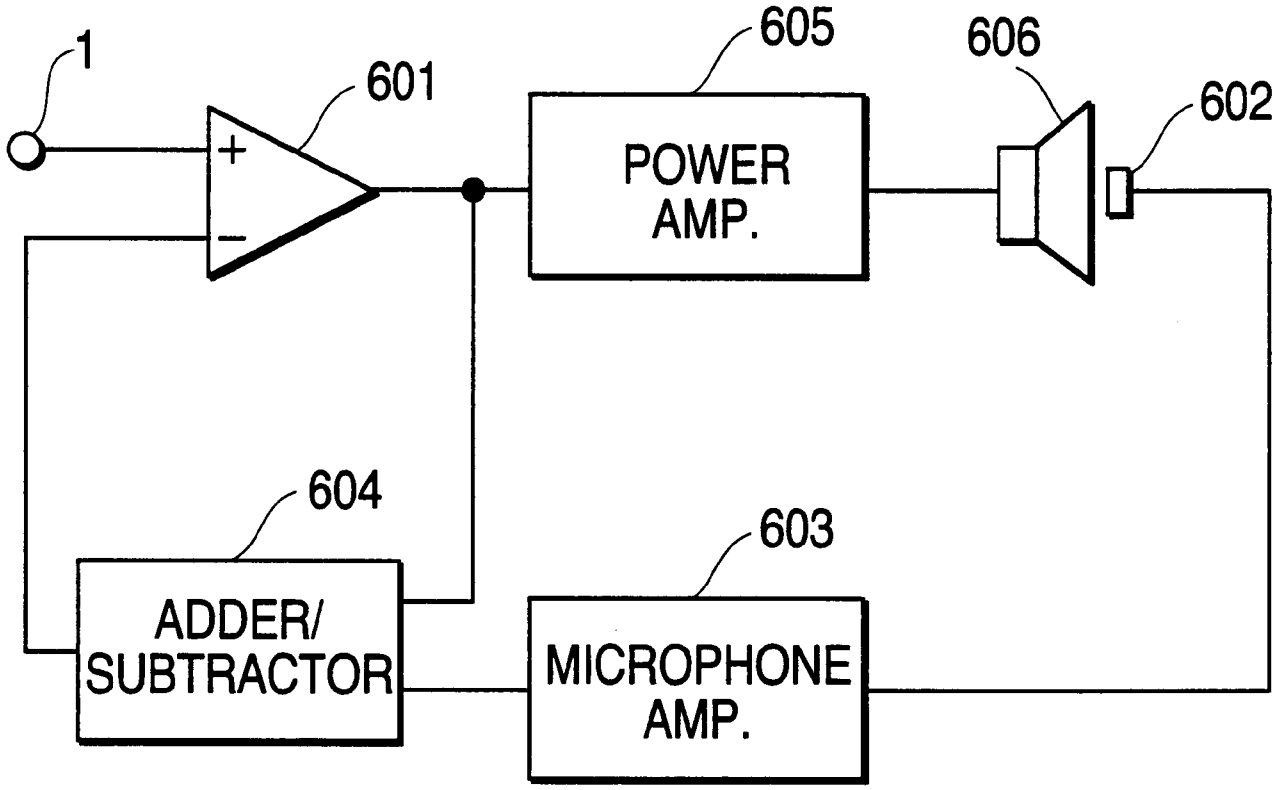
FIG. 5 is a block diagram showing the sound feedback circuit of FIG. 4.

The sound feedback circuit 607 comprises, as shown in FIG. 5, a subtracter 601 in which an input terminal 1 to be connected with output of the sound source 611 is connected to a reverse input terminal, a microphone amplifier 603 to which an output signal of microphone 602 is inputted, and an adder/subtracter 604 which processes the output of microphone amplifier 603 and the sound signal to be inputted to power amplifier 605 arithmetically, the output of adder/subtracter 604 is connected to a non-reversal input terminal of the subtracter 601.

The pulse width modulation type power amplifier 605 is a power amplifier which is compact yet yields a high output. By incorporating the power amplifier 605 in advance within a sound producing apparatus, integration with other sound producing apparatus for a higher performance turns out easy. The startup of sound producing output is also improved by a servo-effect of the sound feedback circuit 607.

Figure 6:
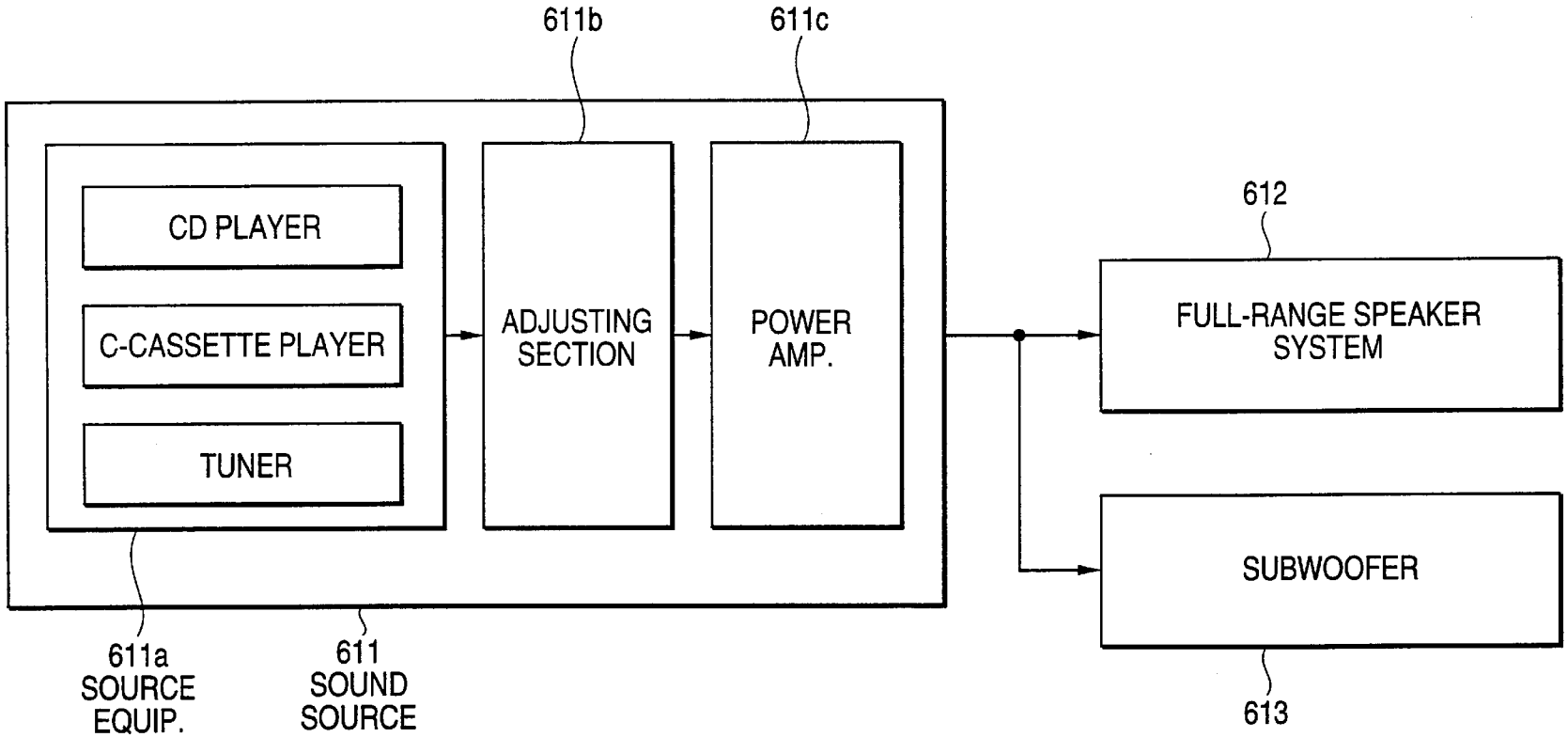
FIG. 6 is a constitution of a car-borne sound apparatus comprising the subwoofer of FIG. 4.

FIG. 6 shows a constitution of a car-borne sound producing apparatus, in which a speaker system according to the present embodiment is incorporated as subwoofer. Basically, this is comprised of a sound source 611 and a full-range speaker system 612. In FIG. 6, the sound source 611 comprises a sound source equipment 611*a* such as a compact disk player, a compact cassette player, a tuner etc., an adjusting section 611b for adjusting the volume, tone of sound source, and a power amplifier 611*c* for amplifying sound output signal therefrom. The full-range speaker system 612 reproduces sound output signal of sound source 611 in a room of a car. The subwoofer 613 is a Kelton type speaker system having passive radiator according to the present embodiment, coupled with sound output signal from sound source 611. The use of subwoofer 613 improves the low range frequency characteristics. Furthermore, a phase relative to other sound producing apparatus may be optimized by delivering to subwoofer 613 a sound signal which is reverse-phased with respect to a sound signal applied to full-range speaker system 612.

Figure 9:
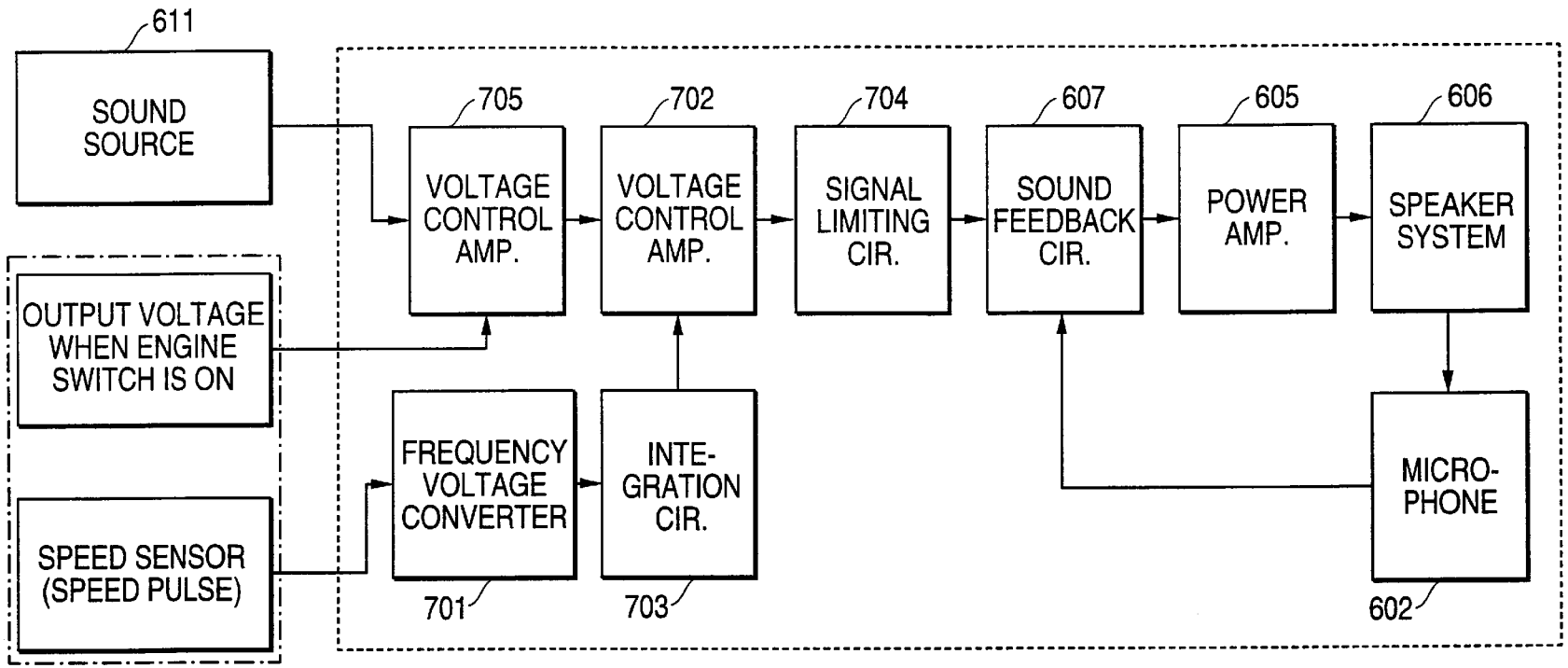
FIG. 9 is a block diagram of a sound producing apparatus having the speaker system of FIG. 1 used as subwoofer.

FIG. 9 shows another car-borne sound producing apparatus in which a speaker system according to the present embodiment is used as subwoofer. The sound producing apparatus comprises a frequency voltage converter 701 which converts the frequency of car speed pulse delivered from car into a direct current voltage proportionate to the car speed, a voltage control amplifier 702 which amplifies sound input signal and outputs a sound signal proportionate to control voltage of the frequency voltage converter 701, an integration circuit 703 which prevents the output signal of voltage control amplifier 702 from making a frequent fluctuation according to control voltage of frequency voltage converter 701, a signal limiting circuit 704 which suppresses an excessive sound output signal when a sound volume of speaker system 606 is large enough not to be affected by room noise, a voltage control amplifier 705 which controls sound signal according to an output voltage when engine switch is ON so as an appropriate sound volume is obtained when a car is stopped with engine keep idling, a pulse width modulation type power amplifier 605 which amplifies only low range output power signal of voltage control amplifier 702, a speaker system according to the present embodiment 606 which reproduces sound output signal of power amplifier 605, and a sound feedback circuit 607 which controls sound signal based on output signal of microphone 602 provided for detecting sound signal radiated from speaker system 606, the feedback circuit 607 being formed between signal limiting circuit 704 and power amplifier 605.

The signal limiting circuit 704, feedback circuit 607 and power amplifier 605 constitute a power amplifying means for amplifying only the low range signal of sound output signal from voltage control amplifier 702, and delivering the amplified power to speaker system 606. The sound feedback circuit 607 is as shown in FIG. 5.

The operation of a car-borne sound producing apparatus constituted as above is described in the following. A sound signal delivered from sound source 611 is inputted to voltage control amplifier 705. The amplification of voltage control amplifier 705 goes higher for a certain level upon detecting a voltage that appears when engine switch of a car is ON. Frequency voltage converter 701 is supplied with pulse of a car speed, and delivers a control voltage proportionate to the car speed to voltage control amplifier 702 via integration circuit 703. A sound signal outputted from voltage control amplifier 705 is inputted to voltage control amplifier 702. The amplification of voltage control amplifier 702 is controlled in proportion to the control voltage of frequency voltage converter 701, namely a speed of the car. Sound output of voltage control amplifier 702 is inputted to signal limiting circuit 704. The signal limiting circuit 704 suppresses excessive sound volume accompanied by an increased car speed, when sound volume of subwoofer is large enough not to be affected by road noise and other room noises. Sound output signal of signal limiting circuit 704 is inputted to sound feedback circuit 607.

The sound feedback circuit 607 detects the sound output of speaker system 606 with microphone 602, and forms a feedback loop with a microphone amplifier, a subtracter and an adder/subtracter, to improve the sound producing output of subwoofer through a servo-effect. Sound output of sound feedback circuit 607 is inputted to the pulse width modulation type power amplifier 605. The pulse width modulation type power amplifier 605 has a built-in low pass filter circuit etc., and amplifies only the low range power. Speaker system 606 is supplied with sound output signal of pulse width modulation type power amplifier 605, and outputs a reproduced sound in a room of the car.

The noise level in a car room is higher when, in the order, a car is in stop, engine in idling state, running at low speed, running at moderate speed, running at high speed. However, under the above described constitution the sound volume of speaker system, or subwoofer, also increases in proportion to the level of room noise; therefore, the S/N ratio of a sound produced by the subwoofer is improved to keep staying in a fixed value, and a most appropriate sound is reproduced. Meanwhile, when the sound volume of subwoofer is large enough not to be affected by the room noise, the signal limiting circuit 704 suppresses unnecessary increase of subwoofer volume even if the running speed of a car is high. Even if running speed of a car changes frequently, the sound volume of subwoofer never shifts that frequent thanks to the work of integration circuit 703.

As described in the above, the present sound producing apparatus installed in a car avoids the masking phenomenon, by shifting the amplification of power amplifier in low range signal according to a changing road noise caused by changing car speed as well as according to the existence or not of engine noise.

Figure 10:
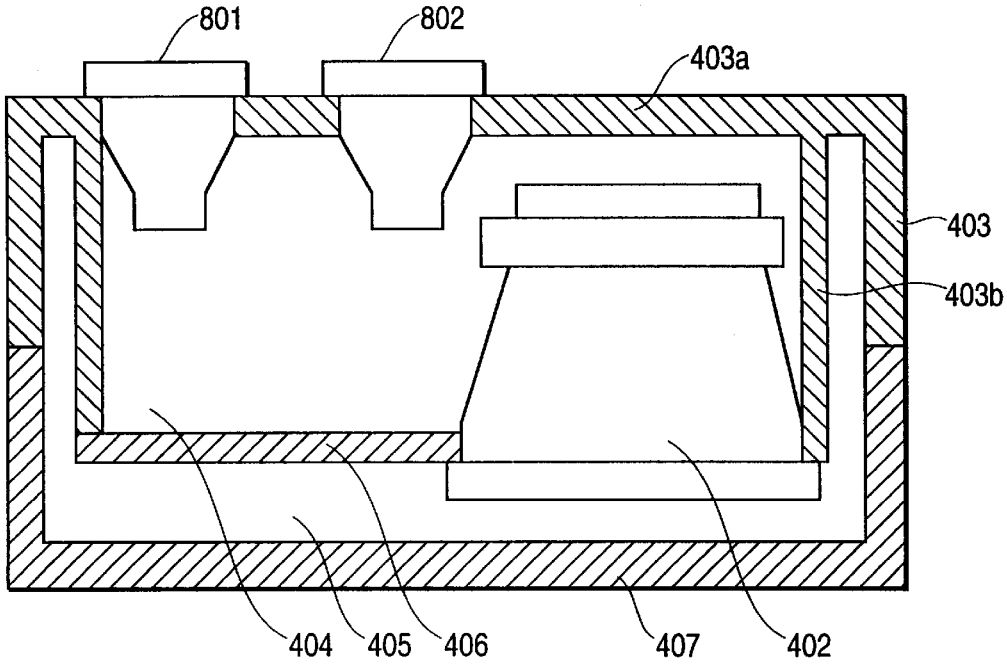
FIG. 10 is a cross sectional view showing a modification of the speaker system of FIG. 1, where the passive radiator is divided.

FIG. 10 shows a modification of the Kelton type speaker system of FIG. 1 having passive radiator, employing a plurality of passive radiators 801, 802. In the case with plural passive radiators, if the total sum of the area and mass of diaphragms is identical to that of the case of a single passive radiator the characteristics will be identical to those of the first embodiment. This provides additional freedom in designing a speaker system.

Figure 11:
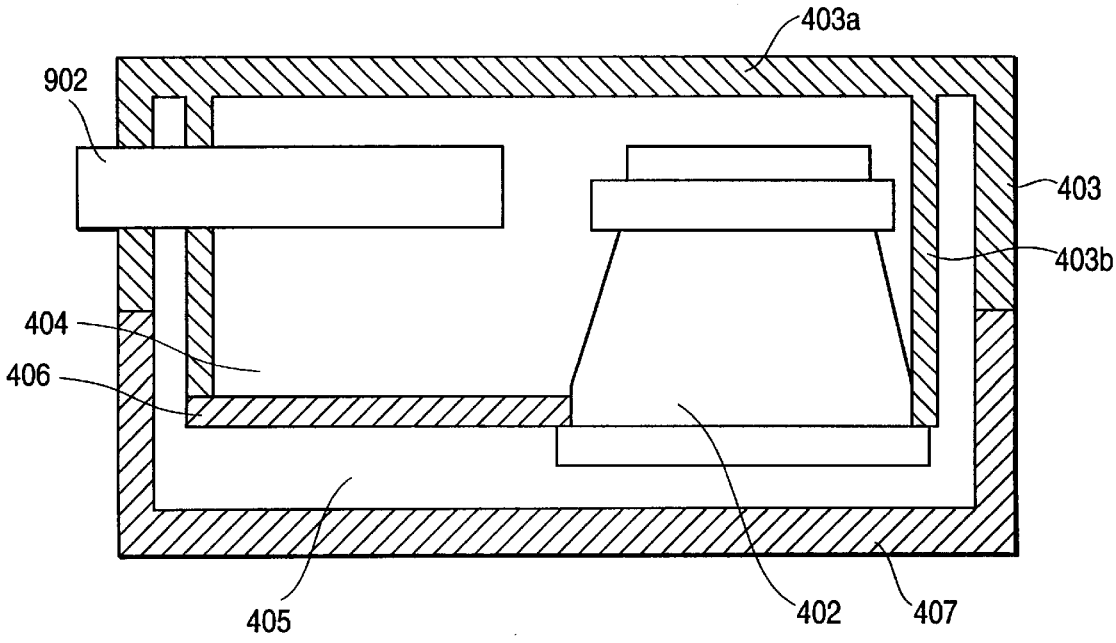
FIG. 11 is a cross sectional view showing another modification of the speaker system of FIG. 1, where a duct is used in place of the passive radiator.

FIG. 11 shows another modification of the speaker system of FIG. 1, in which a duct 902 is used in place of passive radiator 401 in FIG. 1. If the area for internal diameter of duct 902 and the mass of air within duct 902 are identical to the diaphragm of passive radiator 401, a same characteristic as in the first embodiment will be obtainable. This helps simplify the structure of a speaker system.

Figure 12:
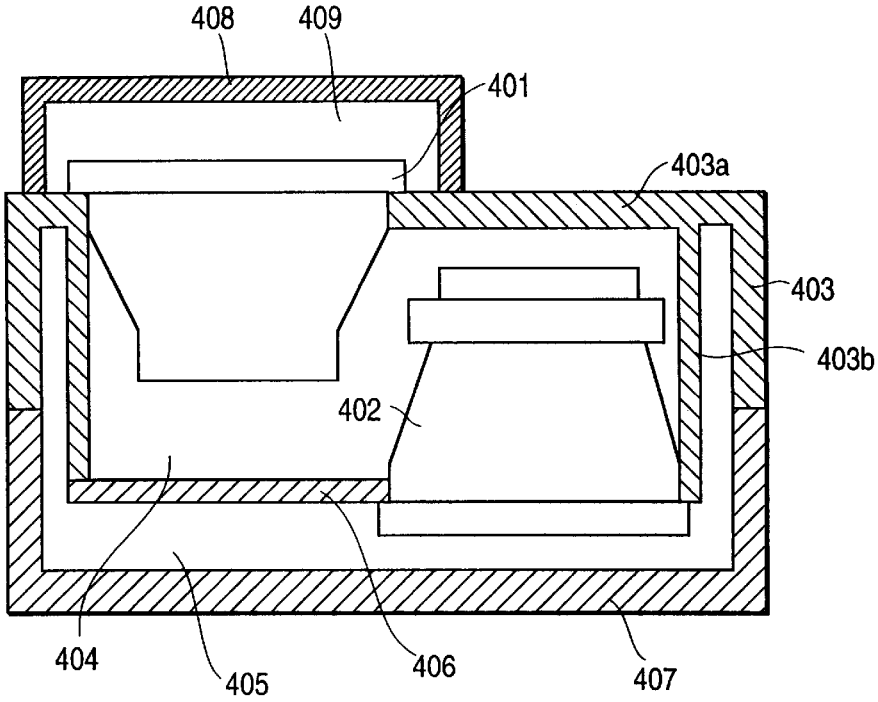
FIG. 12 is a cross sectional view showing a still other modification of the speaker system of FIG. 1, where a diffuser is attached on the passive radiator.

FIG. 12 shows a speaker system which is the speaker system of FIG. 1 further provided with a diffuser 408 on passive radiator 401. A sound output reproduced from passive radiator 401 is reflected by the diffuser 408 to be delivered through a sound output radiating section 409 placed in the side of speaker' box and diffuser 408. This increases the effective equivalent mass against passive radiator 401, bringing about a further extended limit of low range reproduction. Even when goods are placed on a speaker box of the present structure the sound characteristics is not affected; even when the speaker box is installed underneath a car seat a vibration that could make a person sitting on the seat feel unpleasant is alleviated because the sound pressure does not shoot direct up.

(Embodiment 2)

Figure 13:
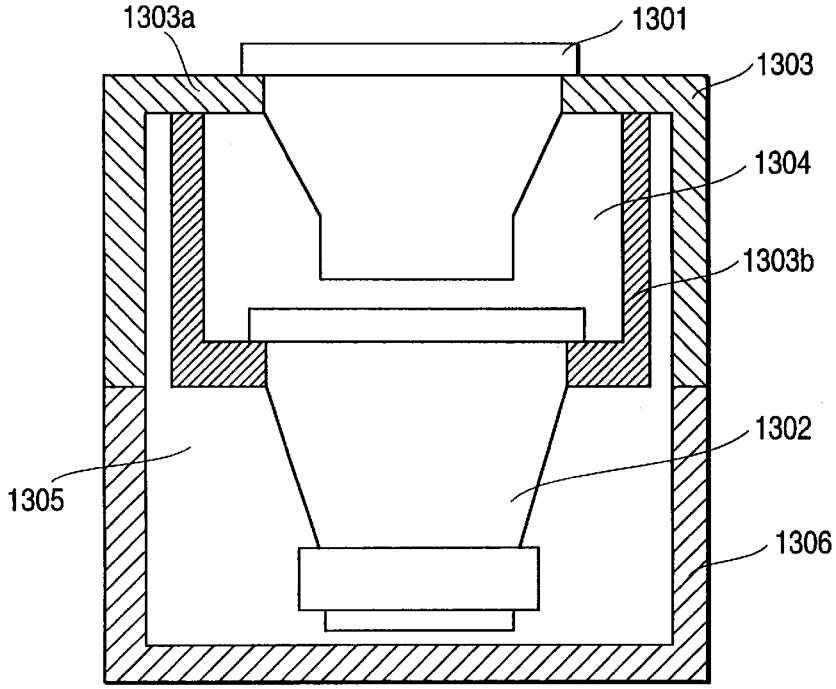
FIG. 13 is a cross sectional view of a Kelton type speaker system having passive radiator according to a second embodiment of the present invention.
Figure 14:
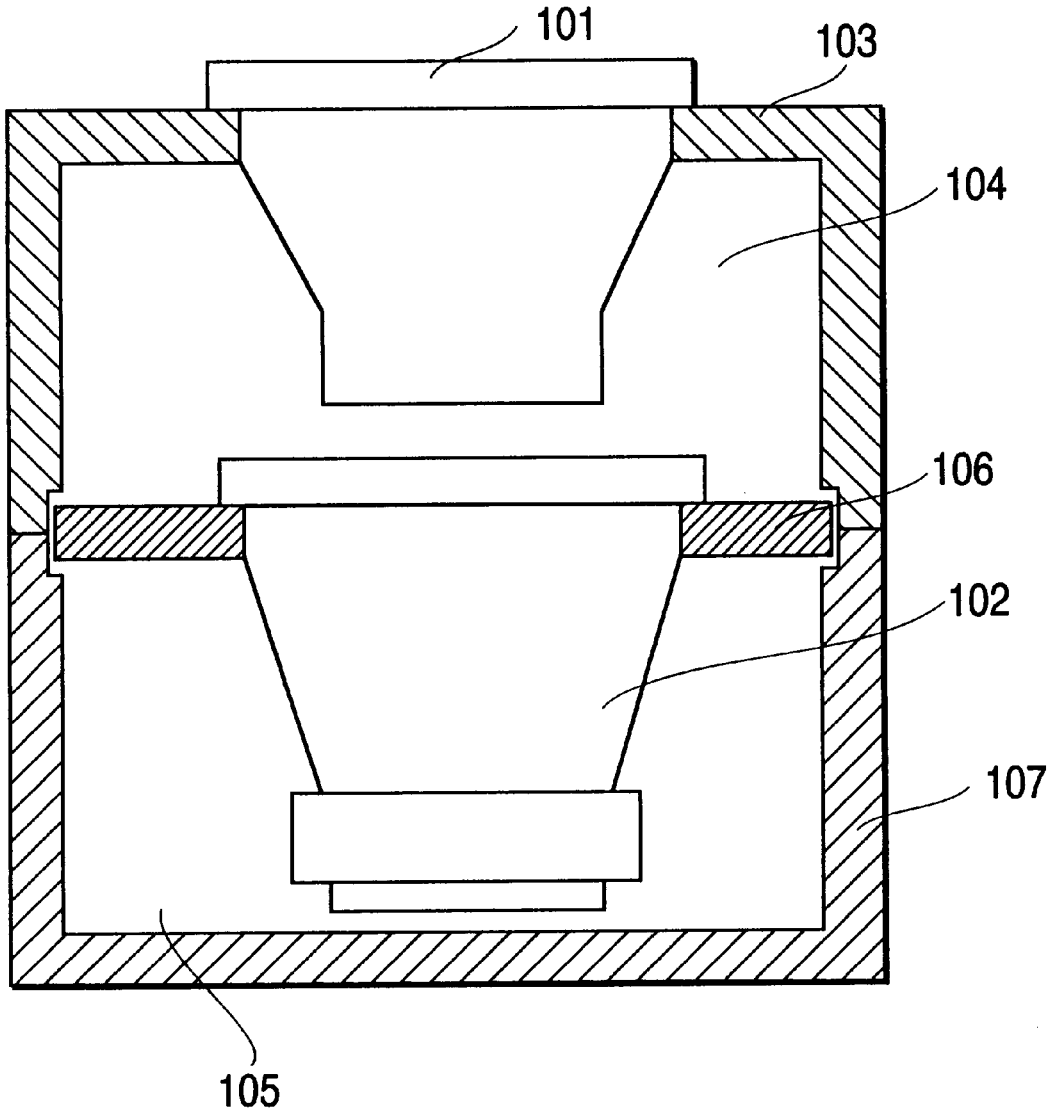
FIG. 14 is a cross sectional view of a conventional Kelton type speaker system having passive radiator.
Figure 15:
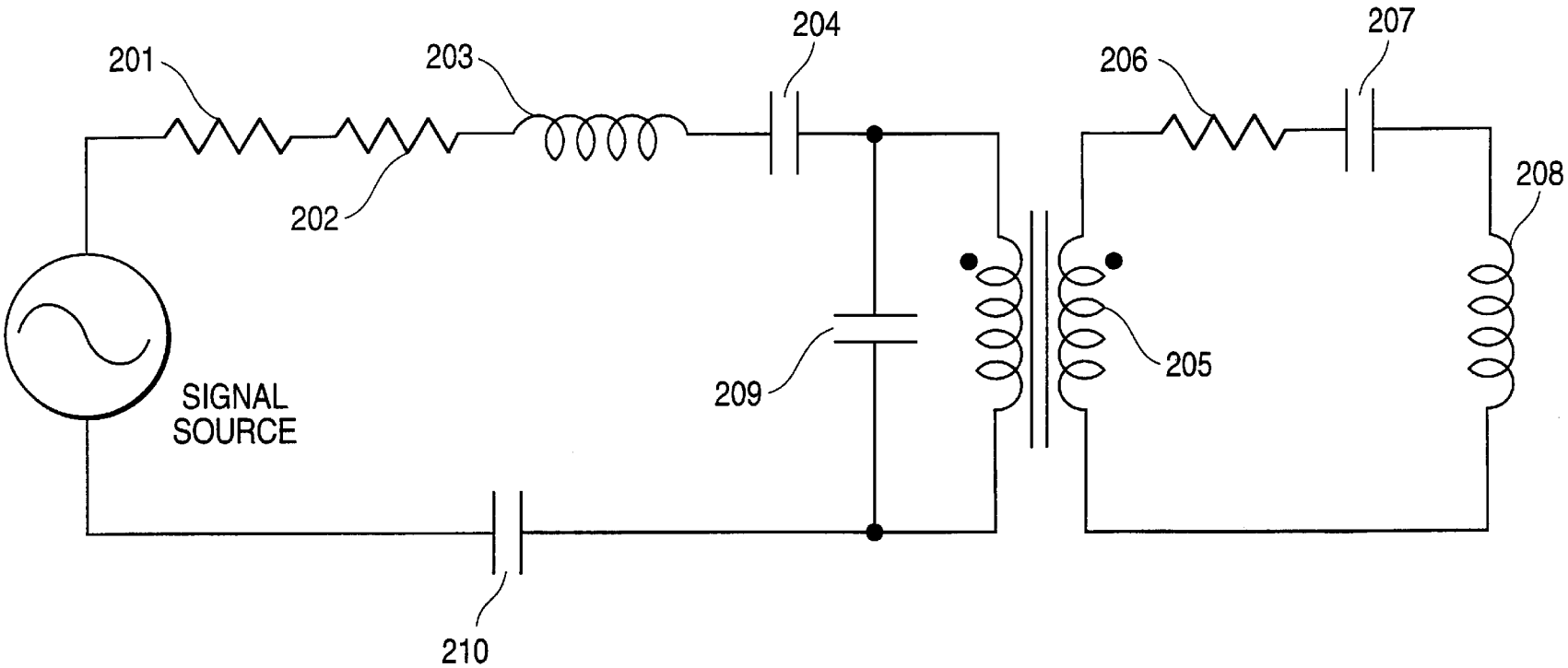
FIG. 15 is an equivalent circuit diagram of the conventional speaker system of FIG. 14.
Figure 16:
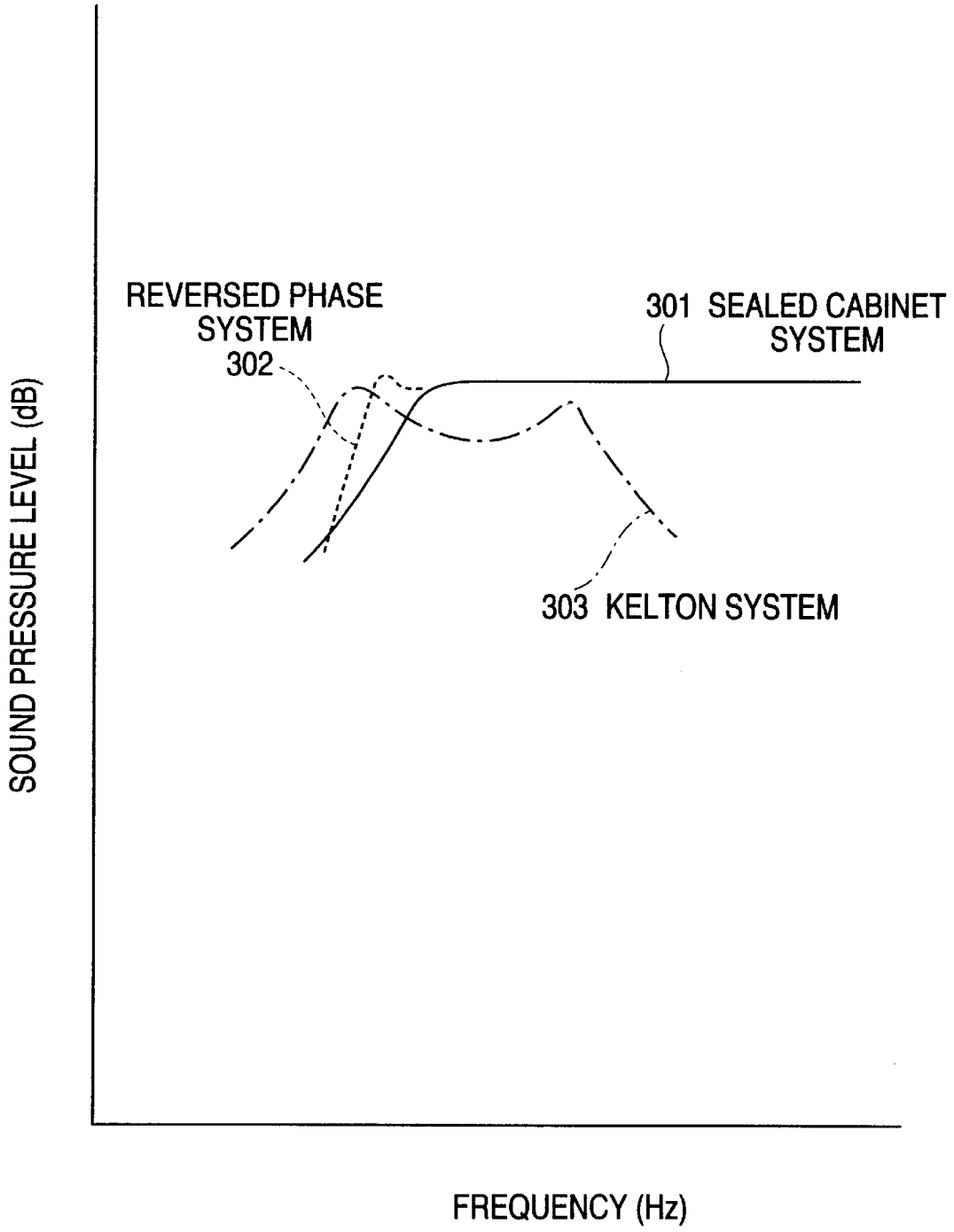
FIG. 16 compares various systems by frequency characteristics curves in the low frequency range.

FIG. 13 is a cross sectional view showing a Kelton type speaker system having passive radiator according to a second embodiment of the present invention. The speaker system comprises a passive radiator 1301 which actually produces a sound, a speaker unit 1302 for driving the passive radiator 1301 with a front sound output, a baffle 1303 on which the passive radiator 1301 and the speaker unit 1302 are mounted and constitutes a part of a speaker box, a front closed cavity 1304 for coupling a front sound output of speaker unit 1302 with passive radiator 1301, a back closed cavity 1305 for sealing the back sound output of speaker unit 1302 in, and a cabinet 1306 which constitutes a speaker box.

The passive radiator 1301 is fixed direct to top board 1303*a* of baffle 1303, the speaker unit 1302 is mounted on the opening of a cylinder 1303*b* which is fixed to top board 1303*a* at a place inner from the end.

In a speaker system according to the second embodiment, sound output from the front of speaker unit 1302 is conducted via the air in front closed cavity 1304 to passive radiator 1301 to produce a sound therefrom. The source of vibration, namely speaker unit 1302 and passive radiator 1301 are mounted direct onto the baffle 1303, the rigidity of which being the highest; therefore, the unwanted vibration of speaker system due to counteraction of speaker unit 1302 is reduced.

In a compact or flat configuration, the direct mounting of speaker unit 1302 onto baffle 1303 helps keep the volume ratio of the front closed cavity reduced; which improves the sound characteristics of a speaker system. The back closed cavity 1305 is to seal the back sound output of speaker unit 1302 in, so as the back sound output from speaker unit 1302 does not interfere with the sound output of passive radiator 1301.

The invention may be embodied in other specific forms without departing from the spirit or essential characteristics thereof. The present embodiments are therefore to be considered in all respects as illustrative and not restrictive. The scope of the present invention is shown by the claims, and not to be restricted by the above explanation. Modifications or changes in the scope of the claims or equivalents thereto are all within the scope of the invention.

What is claimed is:

1. A speaker system comprising:

a speaker unit connected with a sound signal input terminal;

a passive radiator driven by sound output of said speaker unit;

a front closed cavity including said passive radiator, for coupling said sound output with said passive radiator;

a back closed cavity for sealing said sound output in;

a baffle comprising a top board for mounting said passive radiator on and side surfaces; and a cabinet mounted to said baffle, said cabinet in combination with said baffle forming said back closed cavity, wherein said speaker unit is mounted on a mounting member which is fixed to said top board at a place other than the side surfaces of said baffle.

2. A speaker system of claim 1, wherein said mounting member is comprised of a cylinder forming said front closed cavity, and said speaker unit is mounted on the opening of said cylinder.

3. A speaker system of claim 1, wherein said speaker unit is disposed in a reverse arrangement relative to said passive radiator, said front closed cavity couples a sound output delivered from the back of said speaker unit, and said back closed cavity seals a sound output delivered from the front of said speaker unit in.

4. A speaker system of claim 1, wherein said speaker unit is disposed in a same direction as said passive radiator, said front closed cavity couples a sound output delivered from the front of said speaker unit, and said back closed cavity seals a sound output delivered from the back of said speaker unit in.

5. A speaker system of claim 1, wherein diaphragm of said passive radiator is fixed direct to said top board.

6. A speaker system of claim 1, wherein said passive radiator is comprised of plural passive radiators.

7. A speaker system of claim 1, further comprising a diffuser disposed on said passive radiator.

8. A speaker system of claim 1, further comprising a power amplifier including a pulse width modulation amplifier, which is built in said speaker box.

9. A speaker system comprising:

a speaker unit connected with a sound signal input terminal;

a through duct for radiating a sound output of said speaker unit;

a front closed cavity coupled to said through duct, for coupling said sound output with said through duct;

a back closed cavity for sealing said sound output in;

a baffle comprising a top board and side surfaces; and a cabinet mounted to said baffle, said cabinet in combination with said baffle forming said back closed cavity, wherein said speaker unit is mounted on a mounting member which is fixed to said top board at a place other than the side surfaces of said baffle.

10. A speaker system of claim 9, wherein said mounting member is comprised of a cylinder forming said front closed cavity, and said speaker unit is mounted on the opening of said cylinder.

11. A speaker system of claim 9, wherein said front closed cavity couples a sound output delivered from the back of said speaker unit, and said back closed cavity seals a sound output delivered from the front of said speaker unit in.

12. A speaker system of claim 9, wherein said front closed cavity couples a sound output delivered from the front of said speaker unit, and said back closed cavity seals a sound output delivered from the back of said speaker unit in.

13. A sound reproducing apparatus comprising:

a speaker system comprised of a speaker unit connected with a sound signal input terminal, a passive radiator driven by sound output of said speaker unit, a front closed cavity including said passive radiator, for coupling said sound output with said passive radiator, a back closed cavity for sealing said sound output in, a baffle comprising a top board for mounting said passive radiator on and side surfaces, and a cabinet mounted to said baffle, said cabinet in combination with said baffle forming said back closed cavity, wherein said speaker unit is mounted on a mounting member which is fixed to said top board at a place other than the sides surfaces of said baffle;

a power amplifier for delivering a reproduction signal to said speaker system;

a microphone for detecting a sound output signal radiated from either said speaker unit or said passive radiator; and a sound feedback circuit for feeding the sound signal from said microphone to said power amplifier.

14. A sound reproducing apparatus of claim 13, wherein said speaker unit is disposed in a reverse arrangement relative to said passive radiator, said front closed cavity couples a sound output delivered from the back of said speaker unit, and said back closed cavity seals a sound output delivered from the front of said speaker unit in.

15. A sound reproducing apparatus of claim 13, wherein said speaker unit is disposed in a same direction as said passive radiator, said front closed cavity couples a sound output delivered from the front of said speaker unit, and said back closed cavity seals a sound output delivered from the back of said speaker unit in.

16. A sound reproducing apparatus of claim 13, wherein said sound feedback circuit comprises a subtracter disposed in a stage before said power amplifier, a microphone amplifier for amplifying a sound signal detected by said microphone, and an adder/subtracter connected with said subtracter for adding and subtracting the output signal of said microphone amplifier and the input signal of said power amplifier.

17. A sound reproducing apparatus comprising:

a speaker system comprised of a speaker unit connected with a sound signal input terminal, a passive radiator driven by sound output of said speaker unit, a front closed cavity including said passive radiator, for coupling said sound output with said sound passive radiator, a back closed cavity for sealing said sound output in, a baffle comprising a top board for mounting said passive radiator on and side surfaces, and a cabinet mounted to said baffle, said cabinet in combination with said baffle forming said back closed cavity, wherein said speaker unit is mounted on a mounting member which is fixed to said top board at a place other than the side surfaces of said baffle;

a power amplifier for delivering a reproduction signal to said speaker system;

a frequency voltage conversion circuit provided with an input terminal for receiving a car speed pulse;

a first voltage control amplifier for controlling a sound input signal which is based on the output signal of said frequency voltage conversion circuit; and a second voltage control amplifier for controlling a sound input signal which is based on the control signal supplied according to an operating state of engine.

18. A sound to reproducing apparatus of claim 17, wherein said speaker unit is disposed in a reverse arrangement relative to said passive radiator, said front closed cavity couples a sound output delivered from the back of said speaker unit, and said back closed cavity seals a sound output delivered from the front of said speaker unit in.

19. A sound to reproducing apparatus of claim 17, wherein said speaker unit is disposed in a same direction as said passive radiator, said front closed cavity couples a sound output delivered from the front of said speaker unit, and said back closed cavity seals a sound output delivered from the back of said speaker unit in.

20. A sound to reproducing apparatus of claim 17, further comprising an integration circuit for integrating output signal of said frequency voltage conversion circuit, disposed in a stage before said first voltage control amplifier.

21. A sound producing apparatus of claim 17, further comprising a signal limiting circuit for limiting an output signal of either said first voltage control amplifier or second voltage control amplifier, disposed in a stage before said power amplifier.

22. A sound to reproducing apparatus of claim 17, wherein said second voltage control amplifier detects a voltage to be delivered when engine switch is ON, for raising the rate of amplification.

23. A sound reproducing apparatus comprising a full-range speaker system and a low-range speaker system, wherein said low-range speaker system comprises:

a speaker unit connected with a sound signal input terminal;

a passive radiator disposed in a reverse arrangement relative to said speaker unit, and driven by sound output from the back of said speaker unit;

a front closed cavity including said passive radiator, for coupling said sound output from the back of said speaker unit with said passive radiator;

a back closed cavity for sealing said sound output from the front of said speaker unit in;

a baffle comprising a top board for mounting said passive radiator on and side surfaces; and a cabinet mounted to said baffle, said cabinet in combination with said baffle forming said back closed cavity, wherein said speaker unit is mounted on a mounting member which is fixed to said top board at a place other than the said surfaces of said baffle, and said low-range speaker system is supplied with a sound signal which is reverse-phased to a sound signal to be delivered to said full-range speaker system.

* * * * *